US010240247B2

(12) United States Patent
Yahagi et al.

(10) Patent No.: US 10,240,247 B2
(45) Date of Patent: Mar. 26, 2019

(54) ANODE HOLDER AND PLATING APPARATUS

(71) Applicant: EBARA CORPORATION, Tokyo (JP)

(72) Inventors: Mitsutoshi Yahagi, Tokyo (JP); Masaaki Kimura, Tokyo (JP); Junichiro Tsujino, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 15/118,036

(22) PCT Filed: Feb. 5, 2015

(86) PCT No.: PCT/JP2015/053178
§ 371 (c)(1),
(2) Date: Aug. 10, 2016

(87) PCT Pub. No.: WO2015/119182
PCT Pub. Date: Aug. 13, 2015

(65) Prior Publication Data

US 2016/0369421 A1 Dec. 22, 2016

(30) Foreign Application Priority Data

Feb. 10, 2014 (JP) ..... 2014-023477

(51) Int. Cl.
*C25D 17/00* (2006.01)
*C25D 17/10* (2006.01)
(Continued)

(52) U.S. Cl.
CPC ..... *C25D 17/10* (2013.01); *C25D 17/00* (2013.01); *C25D 17/001* (2013.01);
(Continued)

(58) Field of Classification Search
None
See application file for complete search history.

(56) References Cited

U.S. PATENT DOCUMENTS 2,519,945 A * 8/1950 Twele ..... C25D 5/08 134/201
3,431,187 A * 3/1969 Lancy ..... C25C 1/20 204/234

(Continued)

FOREIGN PATENT DOCUMENTS

JP S58-048691 A 3/1983
JP 01-297884 A 11/1989

(Continued)

OTHER PUBLICATIONS

International Patent Application No. PCT/JP2015/053178; Int'l Search Report; dated Apr. 28, 2015; 2 pages.

(Continued)

*Primary Examiner* — Stefanie S Wittenberg
(74) *Attorney, Agent, or Firm* — Baker & Hostetler LLP

(57) ABSTRACT

To provide an anode holder and a plating apparatus including the same, the anode holder being configured to prevent additives and black films from spreading by moving between an internal space in which an anode is provided and an external space.

An anode holder 60 according to the present invention includes: an internal space 61 that houses an anode therein; a diaphragm configured so as to cover a front face of the internal space 61; a hole 71 that is formed on an external surface of the anode holder and which communicates with the internal space 61; and a valve 91 that seals the hole 71 shut.

5 Claims, 13 Drawing Sheets

(51) Int. Cl.
*C25D 17/04* (2006.01)
*C25D 17/06* (2006.01)

(52) U.S. Cl.
CPC ..... *C25D 17/002* (2013.01); *C25D 17/04* (2013.01); *C25D 17/06* (2013.01)

(56) References Cited

U.S. PATENT DOCUMENTS

| | | | | |
|---|---|---|---|---|
| 2002/0027080 | A1 | 3/2002 | Yoshioka et al. | |
| 2002/0029973 | A1* | 3/2002 | Maydan | C25D 17/10 205/96 |
| 2002/0139683 | A1 | 10/2002 | Hongo et al. | |
| 2004/0016647 | A1* | 1/2004 | Yang | A23D 7/00 205/123 |
| 2004/0089555 | A1 | 5/2004 | Sendai et al. | |
| 2004/0256238 | A1 | 12/2004 | Suzuki et al. | |
| 2005/0006244 | A1* | 1/2005 | Uzoh | C25D 5/08 205/148 |

FOREIGN PATENT DOCUMENTS

| | | | |
|---|---|---|---|
| JP | 09-031700 | A | 2/1997 |
| JP | 2000-087299 | A | 3/2000 |
| JP | 2002-146599 | A | 5/2002 |
| JP | 2007-113082 | A | 5/2007 |
| JP | 2010-185122 | A | 8/2010 |
| WO | WO 2001/068952 | A1 | 9/2001 |

OTHER PUBLICATIONS

Hagiwara et al.; "Acid Copper Plating for Via Filling Using IrO2/Ti Insoluble Anode"; Journal of the Japan Institute of Electronics Packaging; vol. 9 No. 3; 2006; p. 180-185 (contains abstract).

* cited by examiner

ANODE HOLDER AND PLATING APPARATUS

CROSS-REFERENCE TO RELATED APPLICATIONS

This application is a national stage of PCT/JP2015/053178 filed Feb. 5, 2015, which is based upon and claims priority to Japanese Patent Application No. 023477-2014 filed Feb. 10, 2014, the entire contents of all of which are incorporated herein by reference.

TECHNICAL FIELD

The present invention relates to an anode holder used in a plating apparatus that applies a plating process to a substrate and the plating apparatus.

BACKGROUND ART

Processes that are conventionally known include a process to form a wiring in a wiring groove, a hole, or a resist opening that is very small in size and is provided on a surface of a semiconductor wafer or the like and a process to have a bump (a projection-shaped electrode) that is electrically connected to an electrode in a package or the like formed on a surface of a semiconductor wafer or the like. As methods for forming such a wiring or a bump, for example, electroplating methods, vapor deposition methods, printing methods, and ball bump methods are known. In recent years, as the number of inputs/outputs (I/O) of semiconductor chips increases and as the pitch becomes smaller, electroplating methods have become more popular, because electroplating methods allow miniaturization and the performance thereof is relatively stable.

A plating apparatus used in an electroplating method includes: a substrate holder that holds a substrate such as a semiconductor wafer or the like; an anode holder that holds an anode; and a plating bath that contains a plating solution including a large number of types of additives. When the plating apparatus performs a plating process on the surface of the substrate (e.g., the semiconductor wafer), the substrate holder and the anode holder are arranged so as to face each other in the plating bath. In this state, when an electric current is arranged to flow between the substrate and the anode, a plating film is formed on the surface of the substrate. The additives have, among others, an effect of accelerating or decelerating the speed at which the plating film is formed, as well as an effect of improving the quality of the plating film.

Conventionally, as an anode held by an anode holder, a soluble anode that can be dissolved in a plating solution or an insoluble anode that is not dissolved in a plating solution has been used. When a plating process is performed by using an insoluble anode, oxygen is generated by a reaction between the anode and the plating solution. The additives in the plating solution are decomposed by reacting with the oxygen. When the additives are decomposed, a problem arises where the additives lose the abovementioned effects and it becomes impossible to form a desired film on the surface of the substrate (see Patent Literature 1, for example). Further, when phosphorus-containing copper is used as a soluble anode, for example, it is known that the quality of the additives, especially accelerants, changes due to a reaction with monovalent copper generated from the anode during non-electrolysis time periods.

Further, when phosphorus-containing copper is used as a soluble anode, for example, a so-called black film, which is a phosphate coating film, is formed on the surface of the anode as the anode is electrolyzed during the plating process (see Non-Patent Literature 1, for example). There is a possibility that such a black film may come off the surface of the anode during the plating process. When the black film that came off the surface moves through the plating solution and adheres to the surface of the substrate, no plating film is formed in such a part of the surface of the substrate to which the black film adhered. Consequently, a problem arises where the plated surface has a defect, and the yield and the reliability of the final product is degraded. To cope with this situation, an anode holder is known with which a diaphragm is provided for the purpose of inhibiting additives from being decomposed and inhibiting black films from adhering to the surface of a substrate (see Patent Literature 2, for example).

FIG. 16 is a partial cross-sectional view of a conventional anode holder including a diaphragm. As illustrated in FIG. 16, an anode holder 110 includes: an anode 105; an anode holder base 111 that has a space for housing the anode 105 therein; an anode mask 113 attached to the front face of the anode holder base 111; a diaphragm 150 attached to the front face of the anode mask 113; a contact member 102 that is electrically conductive and is in contact with the rear face of the anode 105; and a power supply member 103 that is electrically conductive and extends from the rear face of the contact member 102 so as to be connected to an external electrode (not illustrated).

The anode holder base 111 has a hole 112 which communicates with the space housing the anode 105 therein. When the anode holder 110 is soaked in a plating solution, the plating solution flows into the space housing the anode 105 therein by going through the hole 112, so that the anode 105 is soaked in the plating solution. The contact member 102 is able to supply an electric current from the external electrode to the anode 105 via the power supply member 103. With this arrangement, when the anode holder 110 is soaked in the plating solution, an electric current flows between the anode 105 and the substrate via the plating solution.

The diaphragm 150 is an ion exchange membrane, for example, and is provided so as to separate the front face of the space housing the anode 105 therein from the external space of the anode holder 110. Cations that are generated in the vicinity of the anode 105 are able to reach the surface of the substrate by passing through the diaphragm 150. In addition, the diaphragm 150 is able to prevent any black film formed on the surface of the anode 105 from going therethrough and is thus able to inhibit the black film from spreading in the plating bath. Further, the diaphragm 150 inhibits the additives contained in the plating solution from reaching the anode 105 and thus inhibits the additives from being decomposed.

CITATION LIST

Patent Literature

Patent Literature 1: Japanese Patent No. 2510422

Patent Literature 2: Japanese Patent Laid-Open No. 2010-185122

Non-Patent Literature

Non-Patent Literature 1: Journal of the Japan Institute of Electronics Packaging, Vol. 9, No. 3, "Acid Copper Plating for Via Filling Using IrO2/Ti Insoluble Anode", pages 180-185

SUMMARY OF INVENTION

Technical Problem

There is, however, a possibility with the conventional anode holder 110 described above that the black film that came off the anode 105 may flow out of the space housing the anode 105 to the outside thereof via the hole 112 used for introducing the plating solution and may spread in the plating bath. Further, there is also a possibility that the additives contained in the plating solution may spread in the space housing the anode 105 therein, via the hole 112. In that situation, oxygen or monovalent copper generated from a reaction between the anode and the plating solution keeps reacting with the additives, so that the additives keep being decomposed.

In view of the problems described above, an object of the present invention is to provide an anode holder and a plating apparatus including the same, the anode holder being configured to prevent additives and black films from spreading by moving between the internal space in which an anode is provided and the external space.

Solution to Problem

An anode holder according to one embodiment of the present invention is an anode holder that holds an anode used in a plating apparatus and includes: an internal space that is formed on an inside of the anode holder and that houses the anode therein; a diaphragm configured so as to cover a front face of the internal space; a hole that is formed on an external surface of the anode holder and which communicates with the internal space; and a valve that seals the hole shut.

An anode holder according to another embodiment of the present, invention includes: an biasing member that biases the valve to close; and an operation part that, operates the valve so as to open.

An anode holder according to yet another embodiment of the present invention includes a gripped part to be gripped when the anode holder is transported, and the operation part is provided in the gripped part.

An anode holder according to yet another embodiment of the present invention includes: a shaft of which one end is connected to the valve and of which another end is connected to the biasing member; an intermediate member of which one end is connected to the shaft, and of which another end is connected to the operation part; and a pivot that, rotatably fixes the intermediate member. In the anode holder, the operation part, is a push rod of which one end protrudes from the gripped part and of which another end is connected to said another end of the intermediate member, and when the push rod is pressed down into an inside of the gripped part, the valve moves in a direction opposite to a direction of an biasing force of the biasing member.

An anode holder according to yet another embodiment of the present invention includes: a first sealing member configured so as to hermetically seal a gap between the diaphragm and the front face of the internal space.

An anode holder according to yet another embodiment of the present invention includes: an opening which communicates with a rear face of the internal space; a lid that covers the opening; and a second sealing member configured to hermetically seal a gap between the opening and the lid.

An anode holder according to yet another embodiment of the present invention includes: an air discharging port used for discharging air in the internal space.

In an anode holder according to yet another embodiment of the present invention, the diaphragm is one of an ion exchange membrane and a neutral membrane.

A plating apparatus according to one embodiment of the present invention includes a plating bath configured to house therein the anode holder and includes a transporter that transports the anode holder. In the plating apparatus, the valve included in the anode holder is configured so as to open when the transporter grips the anode holder and so as to close when the transporter releases the grip.

To achieve the object described above, a plating apparatus according to one embodiment of the present invention is a plating apparatus that includes a plating bath, and the plating bath is configured so as to house therein an anode holder including: an internal space that is formed on an inside of the anode holder and that houses the anode therein; a diaphragm, configured so as to cover a front face of the internal space; and a hole that is formed on an external surface of the anode holder and which communicates with the internal space, and the plating bath includes a valve that seals the hole of the anode holder shut.

In a plating apparatus according to yet another embodiment of the present invention, the valve is configured to seal the hole of the anode holder shut, when the anode holder is housed in the plating bath.

Advantageous Effects of Invention

According to the present invention, it is possible to provide an anode holder and a plating apparatus including the same, the anode holder being configured to prevent additives and black films from spreading by moving between the internal space in which the anode is provided and the external space.

DESCRIPTION OF EMBODIMENTS

Figure 1:
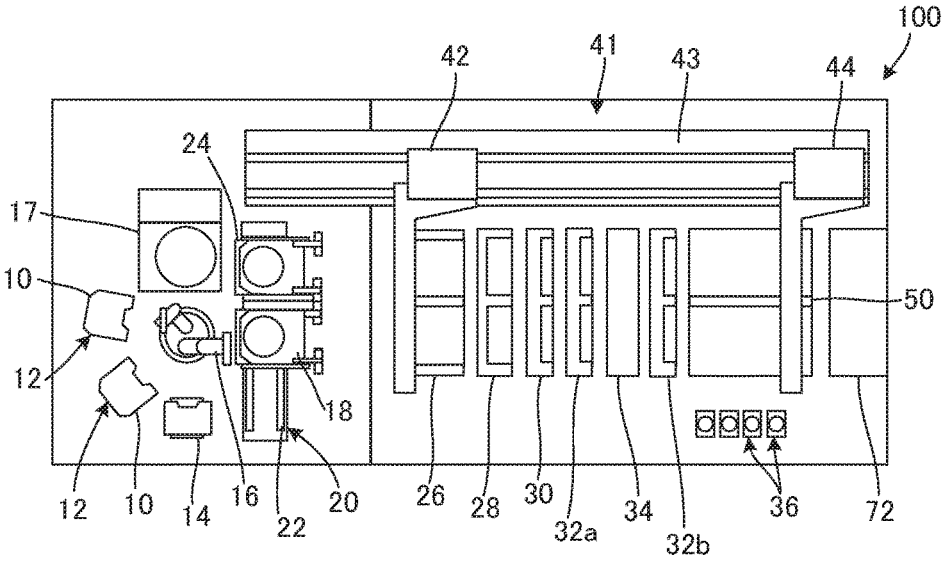
FIG. 1 is a diagram illustrating an overall positional arrangement of a plating apparatus according to a first embodiment.

Embodiments of the present invention will be explained below, with reference to the drawings. In the drawings referred to in the following explanations, some of the constituent elements that are the same as or corresponding to each other will be referred to by using the same reference characters, and duplicate explanations will be omitted.

First Embodiment

FIG. 1 is a diagram illustrating an overall positional arrangement of a plating apparatus according to a first embodiment.

As illustrated in FIG. 1, a plating apparatus 100 includes: two cassette tables 12 on which cassettes 10 that each store therein substrates such as semiconductor wafers are mounted; an aligner 14 that aligns the position of an orientation flat or a notch of each substrate with a predetermined direction; a substrate attaching and detaching unit 20 that attaches and detaches each substrate to and from either of substrate holders 18; and a spin drier 17 that dries each substrate on which a plating process has been performed by spinning the substrate at a high speed. A substrate transporting device 16 that is configured with a transporting robot, for example, and that transports each substrate from one unit to another is provided substantially at the center of these units.

Each substrate is taken out of either of the cassettes 10 mounted on the cassette tables 12 by the substrate transporting device 16 and is transported to the aligner 14. The aligner 14 aligns the position of the orientation flat or the notch of the substrate with the predetermined direction. After that, the substrate is transported to the substrate attaching and detaching unit 20 by the substrate transporting device 16. The substrate attaching and detaching unit 20 includes a mount plate 24 that has a planar shape and is slidable in horizontal directions along a rail 22. On the mount plate 24, the two substrate holders 18 that are positioned horizontally side by side are mounted. The substrate transporting device 16 relays one substrate to one of the two substrate holders 18. Subsequently, the mount plate 24 is slid in a horizontal direction, so that the substrate transporting device 16 relays another substrate to the other substrate holder 18.

Further, the plating apparatus 100 has provided therein: stockers 26 that store therein and temporarily store therein the substrate holders 18; pre-vetting baths 28 used for soaking the substrates in pure water; pre-soaking baths 30 used for removing an oxide film from the surface of a seed layer formed on the surface of the substrates; first rinsing baths 32*a* used for washing and cleaning the pre-soaked substrates; a blow bath 34 used for draining the substrates that have been washed and cleaned; second rinsing baths 32*b* used for washing and cleaning the substrates that have been plated; plating baths 50 used for performing a plating process; and a holder relay unit 72 that takes out either of the substrate holders 18 requiring maintenance work or the like, from the plating apparatus 100.

Further, the plating apparatus 100 includes a substrate holder transporting device 41 that transports either of the substrate holders 18 together with the substrate. The substrate holder transporting device 41 is arranged in a lateral position with respect to the substrate attaching and detaching unit 20 and the baths described above. The substrate holder transporting device 41 includes a first transporter 42 that transports each substrate between the substrate attaching and detaching unit 20 and a corresponding one of the stockers 26; a second transporter 44 that transports each substrate among a corresponding one of the stockers 26, the pre-wetting baths 28, the pre-soaking baths 30, the first rinsing baths 32*a*, the second rinsing baths 32*b*, the blow bath 34, and the plating baths 50; and a guide rail 43 that guides the first transporter 42 and the second transporter 44. Alternatively, the substrate holder transporting device 41 may be configured so as to include only the first transporter 42, without including the second transporter 44.

Further, in a lateral position with respect to the plating bath 50, a paddle driving device 36 that drives a paddle (not illustrated) positioned on the inside of the plating bath 50 and used for agitating a plating solution is provided.

The first transporter 42 grips, at the same time, the two substrate holders 18 each holding the substrate and being mounted on the mount plate 24 and transports the substrate holders 18 to the stockers 26. Further, the first transporter 42 lowers the two substrate holders 18 while the two substrate holders 18 are positioned upright, so as to be hung and held by the stockers 26. The second transporter 44 grips the two substrate holders 18 held by the stockers 26 and sequentially transports the two substrate holders 18 to the pre-wetting baths 28, the pre-soaking baths 30, the first rinsing baths 32*a*, the plating baths 50, the second rinsing baths 32*b*, and the blow bath 34.

The second transporter 44 returns the two substrate holders 18 holding the substrates having been processed in the baths to predetermined positions in the stockers 26. The first transporter 42 grips the two substrate holders 18 that have been returned to the predetermined positions in the stockers 26 and transports the two substrate holders 18 to the mount plate 24 included in the substrate attaching and detaching unit 20, so that the substrate holders 18 are horizontally mounted on the mount plate 24.

Subsequently, the substrate transporting device 16 takes the substrate on which the plating process has been performed, out of the substrate holder 18 positioned on the center side of the rail 22 and transports the substrate to the spin drier 17. The spin drier 17 drains the substrate by spinning the substrate at a high speed. The substrate transporting device 16 returns the drained substrate to the cassette 10. The substrate held in the other substrate holder 18 is also similarly drained by the spin drier 17, before being returned to the cassette 10.

When maintenance work or the like is performed on the substrate holders 18 or the anode holders 60 (see FIG. 5 and so on) described later, the second transporter 44 takes the substrate holders 18 out of the stockers 26 or takes the anode holders 60 out of the plating baths 50, so as to transport the substrate holders 18 or the anode holders 60 to the holder relay unit 72.

Figure 2:
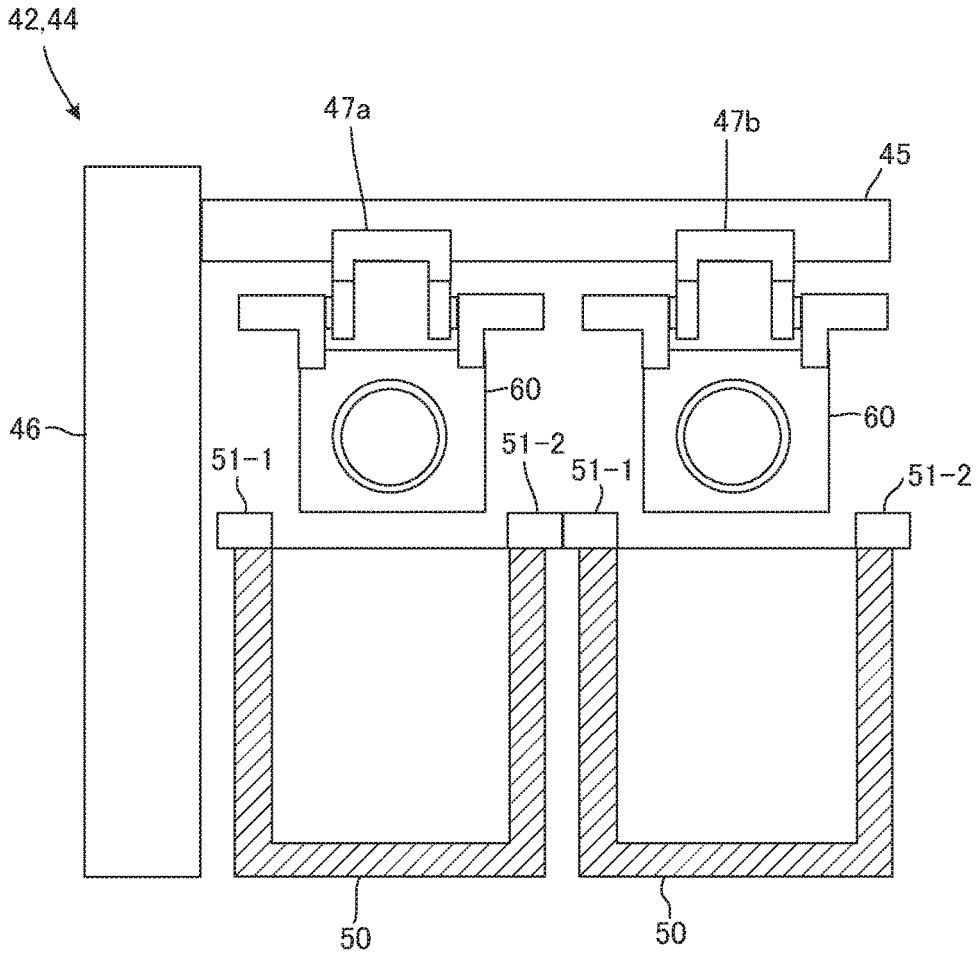
FIG. 2 is a schematic side view of a first transporter or a second transporter.

FIG. 2 is a schematic side view of the first transporter 42 or the second transporter 44 illustrated in FIG. 1. FIG. 2 also illustrates the plating baths 50 for the sake of convenience. As illustrated in FIG. 2, the first transporter 42 or the second transporter 44 (hereinafter, "transporter 42 or 44") includes a supporting pillar 46 and an arm 45 that extends horizontally from the supporting pillar 46. The supporting pillar 46 and the arm 45 are capable of moving along the guide rail 43 (see FIG. 1) in the depth direction of the page of the drawing. Accordingly, the arm 45 is able to move over the baths illustrated in FIG. 1. The arm 45 includes two chucks 47*a* and 47*b* that grip the anode holders 60. The chucks 47*a* and 47*b* are capable of similarly gripping the substrate holders 18.

Each of the plating baths 50 includes, in an upper section of the lateral walls thereof, a pair of supporting members 51-1 and 51-2 used for supporting the anode holder 60 from the lower side thereof. When the anode holders 60 are stored on the inside of the plating baths 50, the arm 45 is lowered by a raising and lowering mechanism built into the supporting pillar 46, so that the anode holders 60 are hung and held by the supporting members 51-1 and 51-2.

Figure 3:
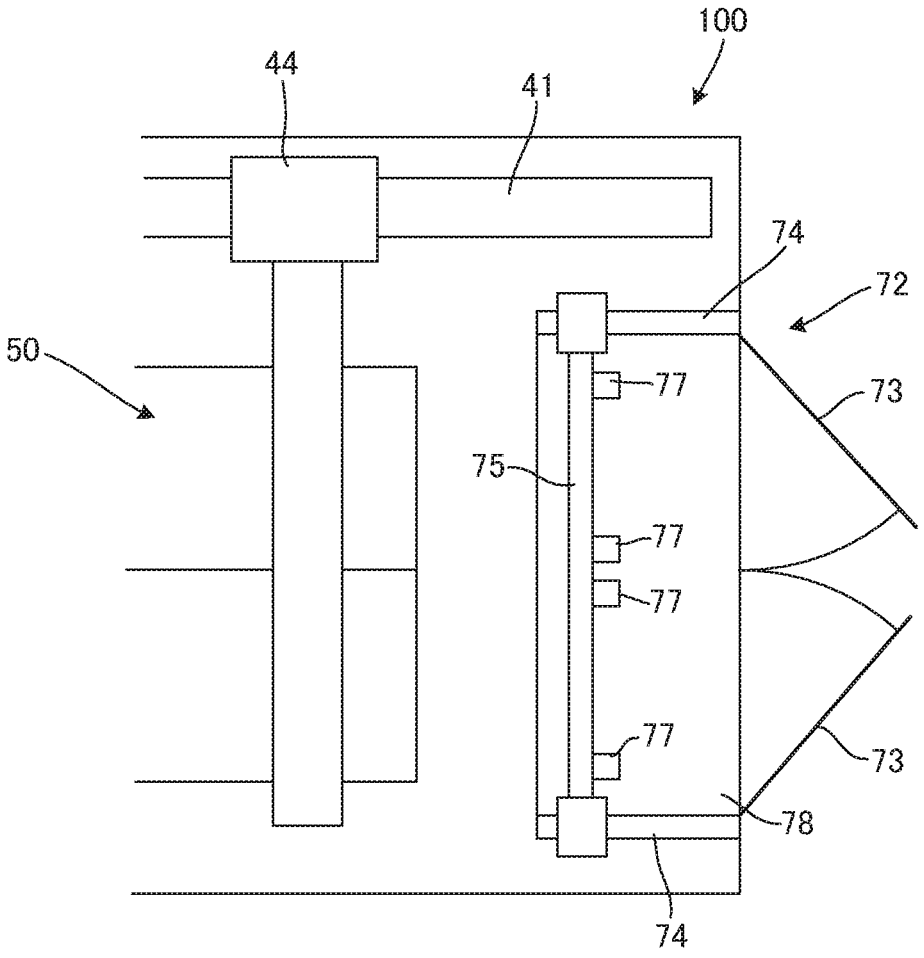
FIG. 3 is a schematic enlarged view of a holder relay unit.

FIG. 3 is a schematic enlarged view of the holder relay unit 72 illustrated in FIG. 1. As illustrated in FIG. 3, the holder relay unit 72 includes: an opening area 78 positioned on the inside of the plating apparatus 100; a pair of doors 73 that close the opening area 78; a hanging bar 75 that hangs and holds the anode holders 60 (see FIG. 2 and so on) and the substrate holders 18 (see FIG. 1 and so on); and a pair of linear guides 74 that guides the hanging bar 75 in horizontal directions.

The hanging bar 75 and the linear guides 74 are positioned on the inside of the opening area 78. The hanging bar 75 includes two pairs of holder supporting parts 77 that support the anode holders 60 and the substrate holders 18 from underneath thereof. When maintenance work such as replacing a component part is performed on the substrate holders 18 or the anode holders 60, the second transporter 44 transports the substrate holders 18 or the anode holders 60 to the holder relay unit 72, so as to be hung and held by the holder supporting parts 77. The doors 73 are biparting doors that open toward the outside of the plating apparatus 100. With this arrangement, communication is allowed from the opening area 78 to the outside of the plating apparatus 100. A person who performs the maintenance work is able to easily take out the substrate holders 18 or the anode holders 60 that are hung by the holder supporting parts 77, by opening the doors 73 and pulling out the hanging bar 75 along the linear guides 74 toward himself/herself (toward the outside of the plating apparatus 100).

Figure 4:
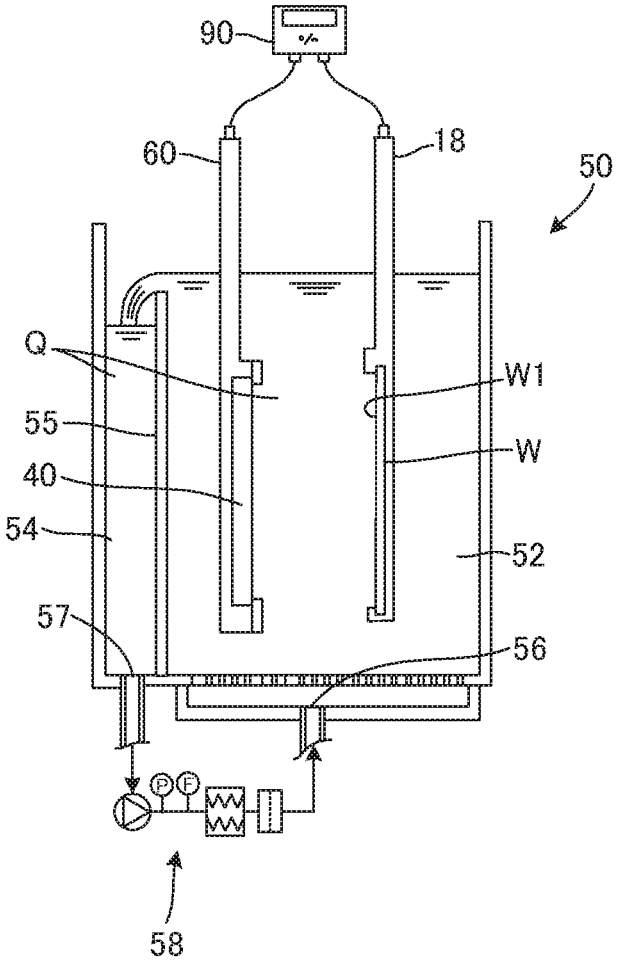
FIG. 4 is a schematic lateral cross-sectional view of a plating bath.

FIG. 4 is a schematic lateral cross-sectional view of one of the plating baths 50 illustrated in FIG. 1. As illustrated in FIG. 4, the plating bath 50 includes: a plating processing tank 52 holding therein a plating solution Q that contains additives; a plating solution discharging tank 54 that receives and discharges any part of the plating solution Q that has overflowed from the plating processing tank 52; and a partition wall 55 that serves as a partition between the plating processing tank 52 and the plating solution discharging tank 54.

The anode holder 60 holding an anode 40 and the substrate holder 18 holding a substrate W are soaked in the plating solution Q held in the plating processing tank 52 and are arranged so as to face each other in such a manner that the anode 40 and a surface of the substrate W are positioned substantially parallel to each other. While being soaked in the plating solution Q held in the plating processing tank 52, a voltage is applied to the anode 40 and the substrate W by a plating power source 30. As a result, metal ions are reduced on a plated surface W1 of the substrate W, so that a film is formed on the plated surface W1.

The plating processing tank 52 includes a plating solution supplying port 56 used for supplying the plating solution Q to the inside of the tank. The plating solution discharging tank 54 includes a plating solution discharging port 57 used for discharging any part of the plating solution Q that has overflowed from the plating processing tank 52. The plating solution supplying port 56 is formed in a bottom section of the plating processing tank 52, whereas the plating solution discharging port 57 is formed in a bottom section of the plating solution discharging tank 54.

When the plating solution Q is supplied to the plating processing tank 52 through the plating solution supplying port 56, the plating solution Q overflows from the plating processing tank 52 and flows into the plating solution discharging tank 54 by going over the partition wall 55. The plating solution Q that has flowed into the plating solution discharging tank 54 is discharged through the plating solution discharging port 57, and impurities are eliminated therefrom by a filter or the like included in a plating solution circulating device 58. The plating solution Q from which the impurities have been eliminated is supplied to the plating processing tank 52 by the plating solution circulating device 58 via the plating solution supplying port 56.

Figure 5:
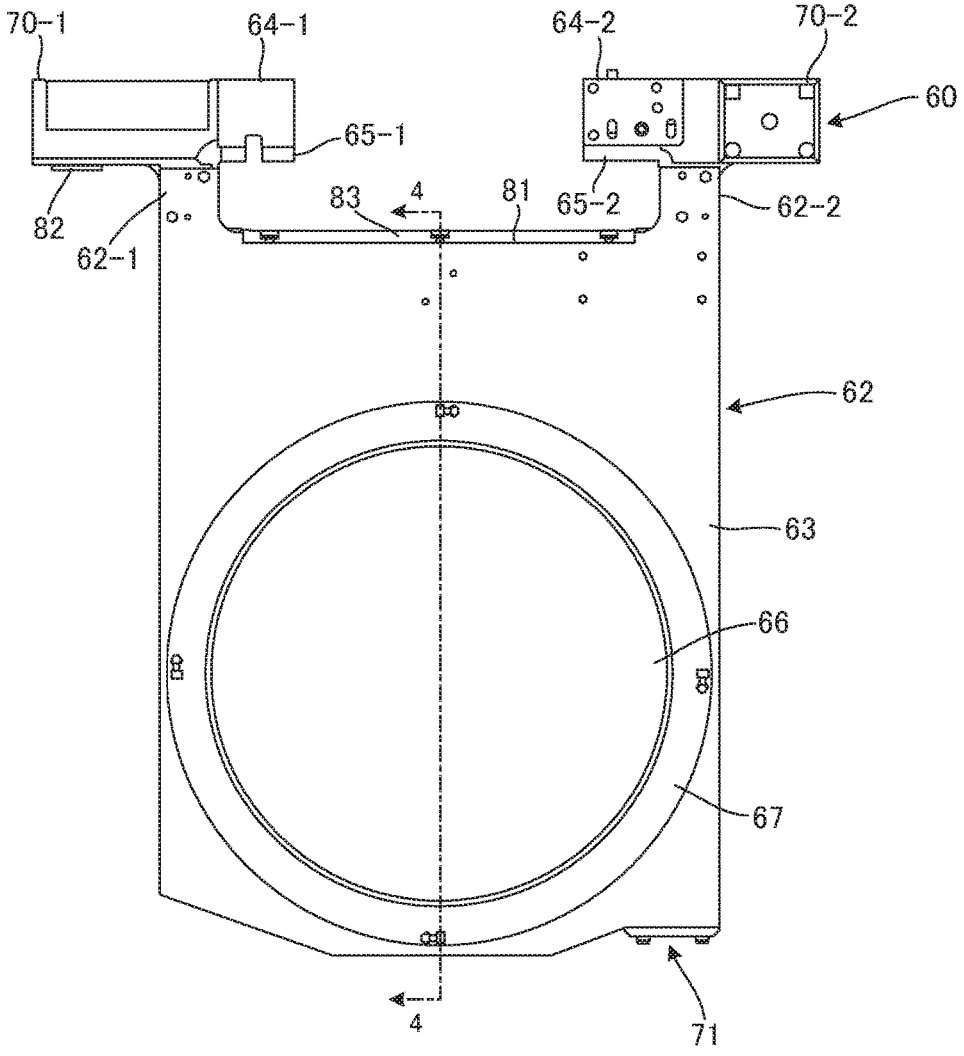
FIG. 5 is a plan view of an anode holder according to the first embodiment.
Figure 6:
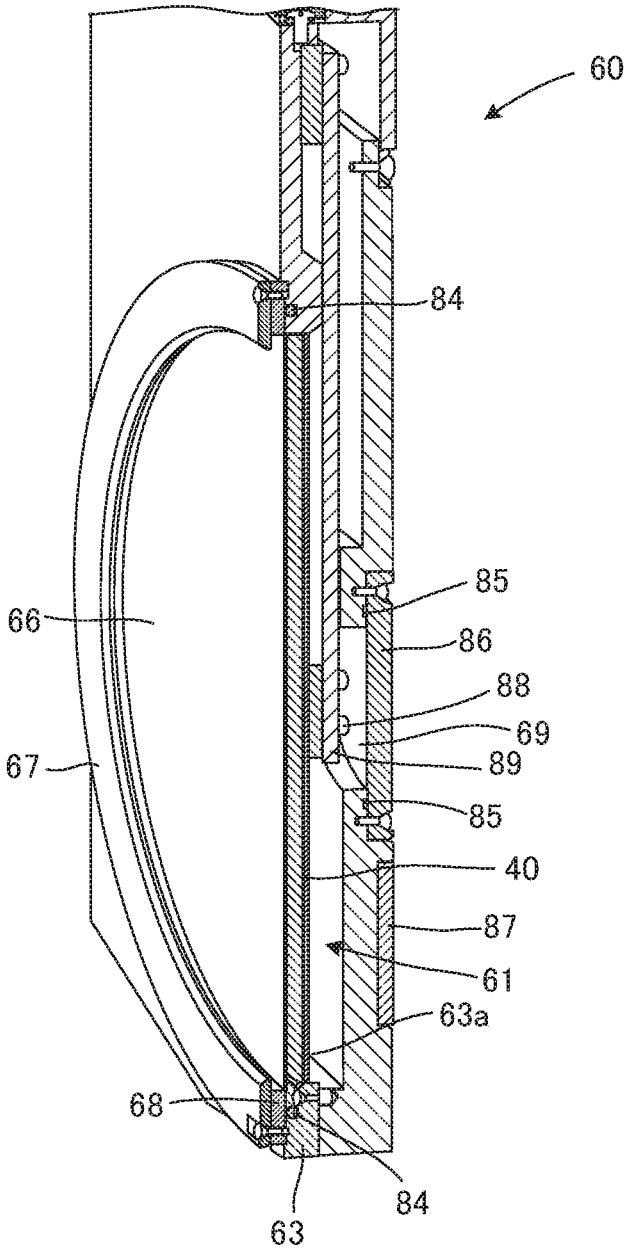
FIG. 6 is a lateral cross-sectional view of the anode holder taken along line 4-4 in FIG. 5.
Figure 7:
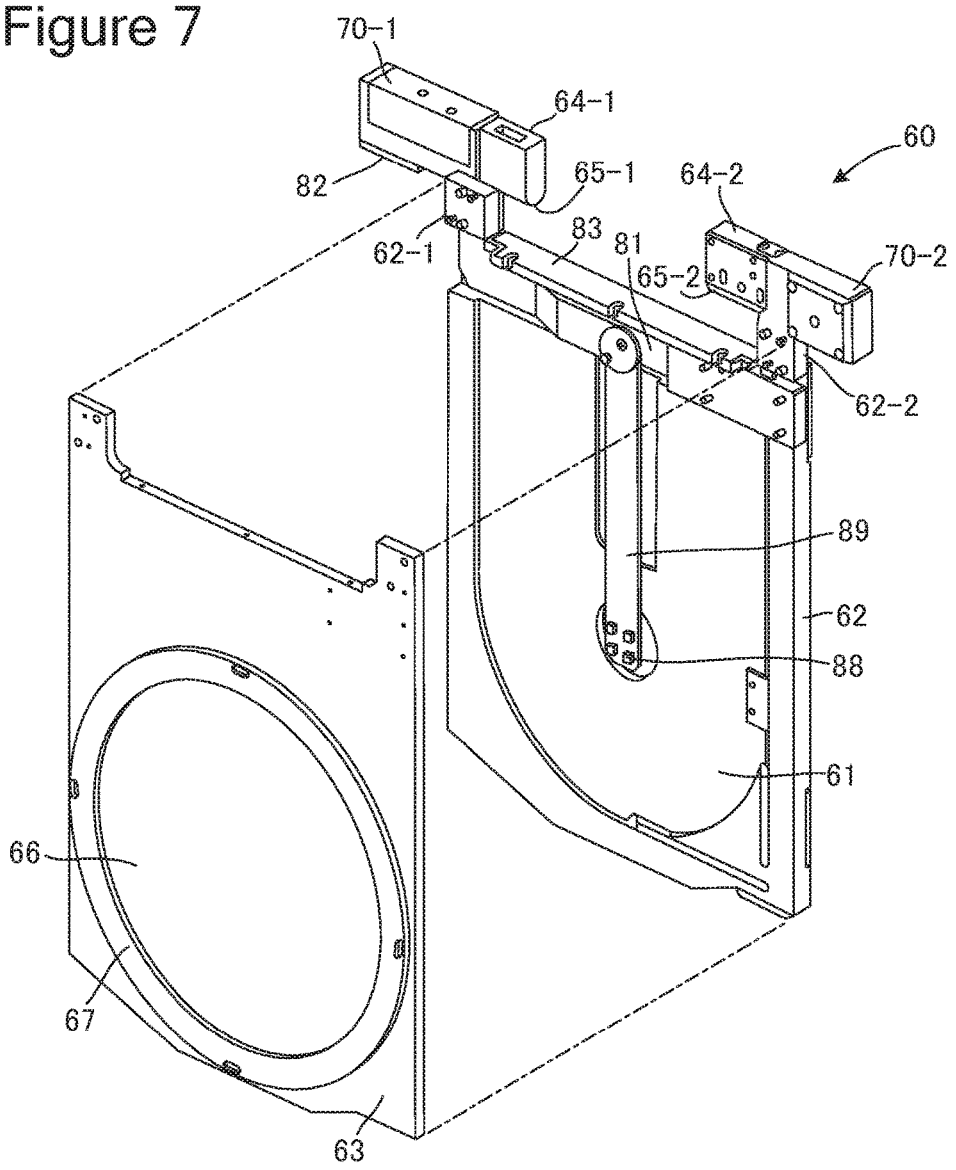
FIG. 7 is an exploded perspective view of the anode holder from which a holder base cover is removed.
Figure 8:
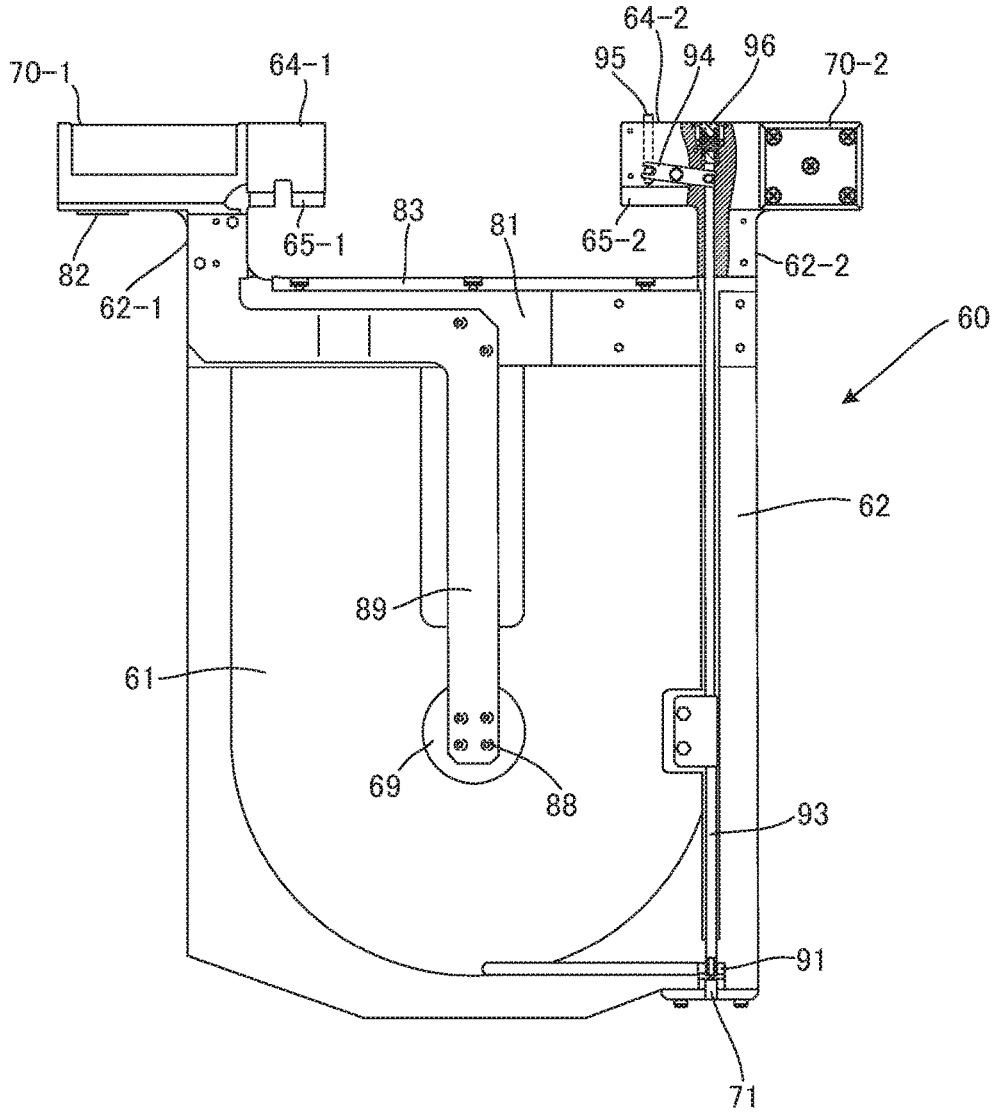
FIG. 8 is a plan view of the anode holder from which the holder base cover is removed.

FIG. 5 is a plan view of the anode holder 60 according to the first embodiment illustrated in FIG. 4. FIG. 6 is a lateral cross-sectional view of the anode holder 60 taken along line 4-4 in FIG. 5. FIG. 7 is an exploded perspective view of the anode holder 60 from which a holder base cover 63 is removed. FIG. 8 is a plan view of the anode holder 60 from which the holder base cover 63 is removed.

For the sake of convenience, FIG. 8 illustrates the anode holder 60 while a gripped part 64-2 is illustrated as being transparent. Further, for the sake of convenience, FIGS. 7 and 8 each illustrate the anode holder 60 from which the anode 40 is removed.

In the present disclosure, "upper (or above)" and "lower (or underneath)" directions denote the upper and the lower directions while the anode holder 60 is vertically housed in the plating bath 50. Similarly, in the present disclosure, "front face" denotes such a face of the anode holder 60 that faces the substrate holder, whereas "rear face" denotes the face opposite from the front face.

As illustrated in FIGS. 5 to 7, the anode holder 60 according to the present embodiment includes: a holder base 62 that is substantially rectangular and has an internal space 61 that houses the anode 40 therein; a pair of gripped parts 64-1 and 64-2 formed in upper sections of the holder base 62; a pair of arm parts 70-1 and 70-2 similarly formed in upper sections of the holder base 62; the holder base cover 63 that partially covers the front face of the holder base 62; a diaphragm 66 provided on the front face of the holder base cover 63 so as to cover the internal space 61; and an anode mask 67 provided on the front face of the diaphragm 66.

As illustrated in FIGS. 5 and 8, the holder base 62 has a hole 71 that extends from the outer surface of a lower section thereof to the internal space 61 so as to communicate with the internal space 61. Further, the holder base 62 has an air discharging port 81 that is positioned between the gripped parts 64-1 and 64-2 provided in the upper sections thereof and is used for discharging air in the internal space 61. When the holder base 62 is soaked in a plating solution, the plating solution flows into the internal space 61 through the hole 71, and also, the air in the internal space 61 is discharged through the air discharging port 81. Further, when an insoluble anode is used as the anode 40, any oxygen that may be generated from the anode 40 during the plating process is also discharged through the air discharging port 81. The air discharging port 81 is closed by a lid 83 configured so as not to hinder the discharging of the air.

Further, as illustrated in FIG. 6, an annular-shaped opening 63*a* that has a diameter larger than the diameter of the anode 40 is formed in a substantially center section of the holder base cover 63. Together with the holder base 62, the holder base cover 63 forms the internal space 61. The diaphragm 66 is provided on the front face of the opening 63*a* so as to close the internal space 61. A diaphragm presser 68 is provided between the diaphragm 66 and the anode mask 67. Further, an annular-shaped first sealing member 84 configured with an O-ring or the like, for example, is provided along the opening 63*a*, on the front face of the holder base cover 63. As a result of the diaphragm 66 being pressed against the first sealing member 84 by the diaphragm presser 68, the diaphragm 66 hermetically seals the opening 63*a*. In other words, the first sealing member 84 is able to hermetically seal the gap between the diaphragm 66 and the internal space 61. Consequently, the internal space 61 and the external space are partitioned while the diaphragm 66 is interposed therebetween.

For example, the diaphragm 66 may be an ion exchange membrane such as a cation exchange membrane or may be a neutral membrane. The diaphragm 66 is able to pass cations from the anode side to the cathode side during a plating process, without passing the additives or black films in the plating solution.

The anode mask 67 is a plate-like member that has an annular opening in a center section thereof and is detachably attached to the front face of the diaphragm presser 68. The diameter of the opening of the anode mask 67 is smaller than the outer diameter of the anode 40. Thus, the anode mask 67 is configured so as to cover an outer perimeter section of the anode 40 in the planar view illustrated in FIG. 5, when the anode mask 67 is attached to the diaphragm presser 68. With this arrangement, the anode mask 67 is capable of controlling the electric field on the surface of the anode 40 during a plating process.

The holder base cover 63 is tightly fixed to the holder base 62 by a thread coupling process or a welding process, so that the holder base cover 63 and the holder base 62 are tightly adhered to each other at the joined section thereof. Alternatively, the holder base cover 63 and the holder base 62 may integrally be formed.

As illustrated in FIGS. 5, 7, and 8, the gripped parts 64-1 and 64-2 are connected to the holder base 62 via connecting parts 62-1 and 62-2 formed in upper sections of the holder base 62. The gripped parts 64-1 and 64-2 are each formed so as to extend from the connecting parts 62-1 and 62-2, respectively, in the direction toward the center of the holder base 62. When the anode holder 60 is transported to each of the baths, the gripped parts 64-1 and 64-2 are gripped by the chuck 47*a* or 47*b* included in the transporter 42 or 44 illustrated in FIG. 2. In lower sections of the gripped parts 64-1 and 64-2, tapered parts 65-1 and 65-2 are formed, respectively, so that the thickness thereof becomes smaller toward the bottom. When the anode holder 60 is gripped, the chuck 47*a* or 47*b* (see FIG. 2) realizes the gripping by pinching the gripped part 64-1 and 64-2 from the front and the back thereof while supporting the tapered parts 65-1 and 65-2 from underneath thereof.

The arm parts 70-1 and 70-2 are formed so as to extend outwardly from the connecting parts 62-1 and 62-2, respectively. When the anode holder 60 is housed in the plating bath 50, the arm parts 70-1 and 70-2 are supported from underneath thereof by the supporting members 51-1 and 51-2 (see FIG. 2) of the plating bath 50. As a result, the anode holder 60 is hung and held with respect to the plating bath 50.

In a lower section of the arm part 70-1, an electrode terminal 82 is provided for the purpose of applying a voltage to the anode 40. When the anode holder 60 is housed in a plating bath, the electrode terminal 82 is in contact with a conductive plate provided for the supporting member 51-1 (See FIG. 2). When the conductive plate is connected to the positive electrode of the plating power source 90, an electric current flows between the electrode terminal 82 and the plating power source 90 (see FIG. 4). Further, the anode holder 60 includes a power supply member 89 that extends from the electrode terminal 82 to a substantially center section of the internal space 61. The power supply member 89 is a substantially plate-like conductive member and is electrically connected to the electrode terminal 82.

As illustrated in FIG. 6, the anode 40 is fixed to the front face of the power supply member 89 by a fixing member 88 configured with a screw or the like, for example. As a result, it is possible to apply the voltage to the anode 40 from the plating power source 90 illustrated in FIG. 4, via the electrode terminal 82 and the power supply member 89.

All annular-shaped opening 69 used for replacing the anode 40 is formed in a substantially center section of the holder base 62, i.e., in a position corresponding to the fixing member 88. The opening 69 is communicated with the rear face side of the internal space 61, and the opening 69 is covered by a lid 86. On the rear face side of the holder base 62, an annular-shaped second sealing member 85 configured with an O-ring or the like, for example, is provided along the opening 69. The second sealing member 85 hermetically seals the gap between the opening 69 and the lid 86.

The lid 86 is removed when the anode 40 is to be replaced. More specifically, when the anode 40 has been used for a certain period exceeding an expected life span thereof, for example, an operator takes off the lid 36 so as to remove the fixing member 88 via the opening 69. The operator removes the anode mask 67 from the diaphragm presser 68 and takes the anode 40 out of the internal space 61. Subsequently, a different anode 40 is housed in the internal space 61 and is fixed to the front face of the power supply member 89 by the fixing member 88 via the opening 69. Finally, the opening 69 is sealed shut by the lid 86, so that the anode mask 67 is attached to the diaphragm presser 68.

On the rear face of the holder base 62, a weight 87 is attached. With this arrangement, when the anode holder 60 is soaked in a plating solution, it is possible to prevent the anode holder 60 from floating to the surface of the plating solution due to buoyancy.

As illustrated in FIG. 8, the anode holder 60 further includes: a valve 91 configured to be able to seal the hole 71 shut; a spring 96 that biases the valve 91 to close; a shaft 93 that transfers the biasing force of the spring 96 to the valve 91; a push rod 95 serving as an operation part that operates the valve 91 so as to open and close; and an intermediate member 94 that transfers any force applied to the push rod 95 to the shaft 93.

The valve 91 is provided on the inside of the holder base 62 so as to be able to seal the hole 71 shut from the inside of the holder base 62. The shaft 93 is provided on the inside of the holder base 62 along the longitudinal direction of the anode holder 60. One end of the shaft 93 is connected to the valve 91, whereas the other end thereof is connected to the spring 96. With this arrangement, the shaft 93 transfers the biasing force of the spring 96 to the valve 91 and biases the valve 91 in such a manner that the valve 91 seals the hole 71 shut from the inside of the holder base 62.

Figure 9:
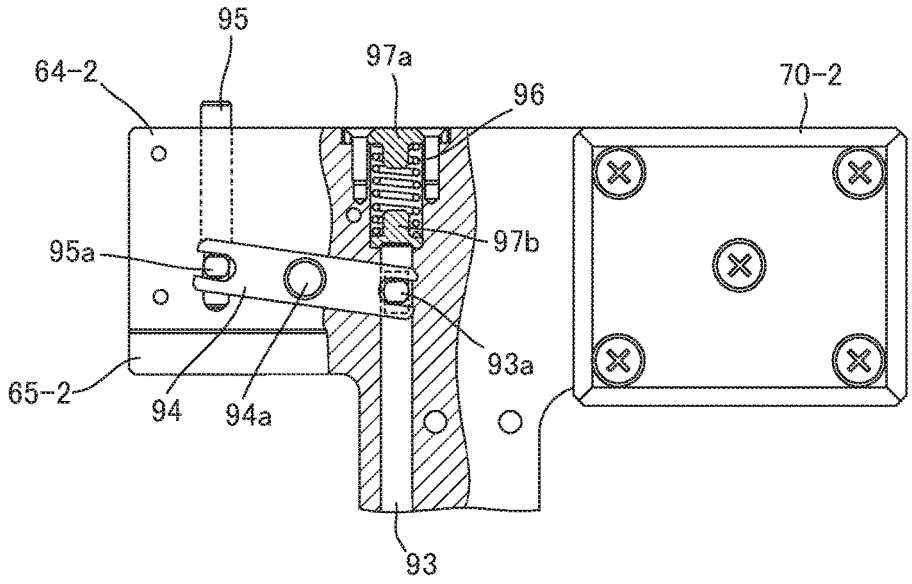
FIG. 9 is an enlarged view of one of the gripped parts illustrated in FIG. 8.

FIG. 9 is an enlarged view of the gripped part 64-2 illustrated in FIG. 8. As illustrated in FIG. 9, a spring seat 97*a* is provided in an upper section of the gripped part 64-2, while a spring seat 97*b* is provided at one end of the shaft 93. One end of the spring 96 is fixed to the gripped part 64-2 by the spring seat 97*a*, whereas the other end thereof is fixed to the shaft 93 by the spring seat 97*b*. With this arrangement, the spring 96 biases the shaft 93 in the axial direction thereof and is thus able to indirectly bias the valve 91 in such a manner that the valve 91 illustrated in FIG. 8 seals the hole 71 shut, i.e., in such a manner that the valve 91 closes.

One end of the push rod 95 protrudes front the gripped part 64-2, while the other end thereof is positioned on the inside of the gripped part 64-2. The push rod 95 is configured so as to be slidable in the axial direction thereof. On the outer circumferential surface of the other end of the push rod 95 positioned on the inside of the gripped part 64-2, a pin 95*a* to be coupled with the intermediate member 94 is formed. Further, on the outer circumferential surface of the shaft 93, a pin 93*a* to be coupled with the intermediate member 94 is formed.

A substantially center section of the intermediate member 94 is fixed to the gripped part 64-2 by a pivot 94*a*, so that the intermediate member 94 is rotatable while using the pivot 94*a* as a rotation center thereof. One end of the intermediate member 94 is connected to the pin 95*a* of the push rod 95, whereas the other end thereof is connected to the pin 93*a* of the shaft 93. With this arrangement, any force applied to the push rod 95 is transferred to the shaft 93, while the pin 95*a* is used as a point of effort, the pivot 94*a* is used as the fulcrum, and the pin 93*a* is used as a point of application.

Figure 10:
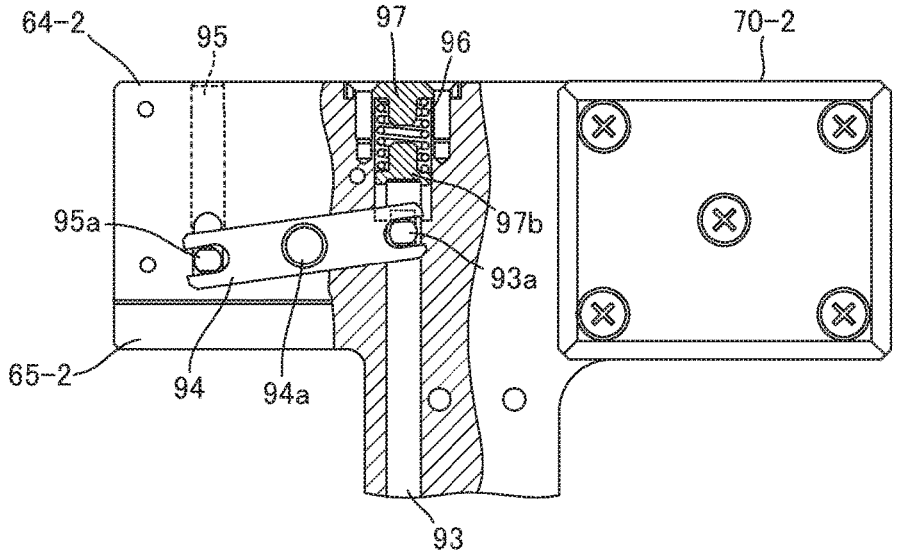
FIG. 10 is a drawing illustrating a manner in which one of the gripped parts illustrated in FIG. 8 is gripped by a transporter.

FIG. 10 is a drawing illustrating a manner in which the gripped part 64-2 illustrated in FIG. 8 is gripped by a transporter. The chuck 47*a* or 47*b* of the transporter 42 or 44 illustrated in FIG. 2 realizes the gripping by pinching the gripped part 64-2 from the front and the back thereof, while supporting the tapered part formed on the lower face of the gripped part 64-2 from underneath thereof. In that situation, as illustrated in FIG. 10, the push rod 95 protruding from the gripped part 64-2 is pushed in toward the inside of the gripped part 64-2 by such a face of the chuck 47*a* or 47*b* (see FIG. 2) that faces the push rod 95. In other words, the push rod 95 is pressed downward. When the push rod 95 is pressed downward, because the pin 95*a* moves downward, the intermediate member 94 rotates while using the pivot 94*a* as a rotation center thereof. In conjunction with this, the spring 96 is compressed, and the pin 93*a* and the shaft 93 move upward (in the direction opposite to the direction of the biasing force of the spring 96). Consequently, the valve 91 (see FIG. 8) connected to the other end of the shaft 93 moves upward, so that the hole 71 is opened.

Figure 11:
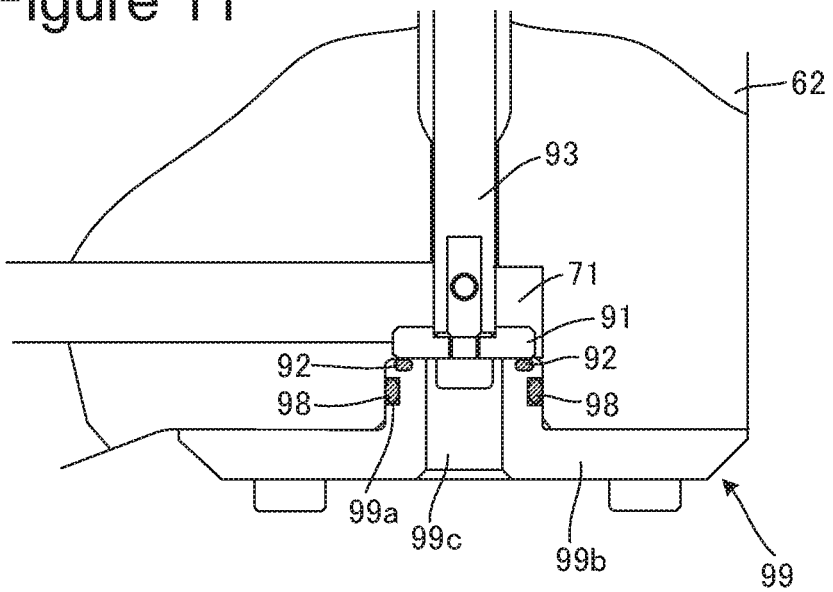
FIG. 11 is an enlarged view of a hole and a valve illustrated in FIG. 8.

FIG. 11 is an enlarged view of the hole 71 and the valve 91 illustrated in FIG. 8. The holder base 62 includes a valve seat 99 that receives the valve 91. The valve seat 99 includes an insertion part 99*a* inserted in the hole 71, a fixation part 99*b* fixed to a lower section of the holder base 62, and a hole 99*c* which communicates with the hole 71. The hole 71 is configured so as to communicate between the internal space 61 (see FIG. 8) and the outside of the holder base 62 via the hole 99*c*.

The insertion part 99*a* is formed to have a substantially circular cylindrical shape. An annular-shaped third sealing member 92 configured with an O-ring, for example, is provided along the hole 99*c*, at a tip end of the insertion part 99*a*. The third sealing member 92 hermetically seals the gap between the valve 91 and the valve seat 99. With this arrangement, when the valve 91 is in contact with the valve seat 99, the hole 71 is sealed shut. In an outer circumferential section of the insertion part 99*a*, an annular-shaped fourth sealing member 98 configured with an O-ring, for example, is provided to hermetically seal the gap between the hole 71 and the valve seat 99. The fourth sealing member 98 prevents the plating solution from passing through the gap between the hole 71 and the valve seat 99. As a result of the valve 91 being biased by the spring 96 (see FIG. 9), the valve 91 is pressed against the valve seat 99, as illustrated in FIG. 11.

Figure 12:
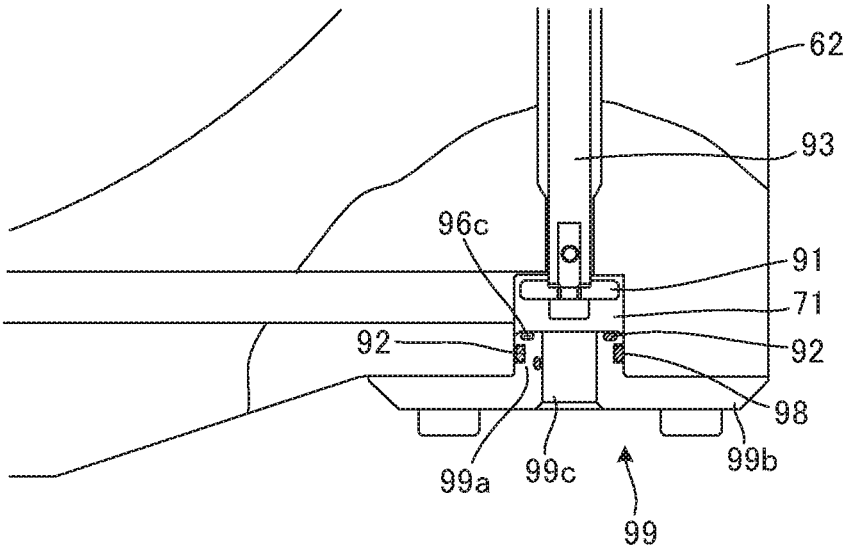
FIG. 12 is an enlarged view of the hole and the valve while one of the gripped parts illustrated in FIG. 8 are being gripped by the transporter.

FIG. 12 is an enlarged view of the hole 71 and the valve 91 while the gripped part 64-2 illustrated in FIG. 8 is being gripped by a transporter. As illustrated in FIG. 10, when the gripped part 64-2 is gripped by the chuck 47*a* or 47*b* (see FIG. 2) of the transporter 42 or 44, the shaft 93 moves toward the top of the anode holder 60. In conjunction with this, the valve 91 moves upward and becomes open, so that the hole 71 is opened, as illustrated in FIG. 12. As a result of the hole 71 being opened, communication is allowed from the hole 71 to the internal space 61, so that the plating solution is able to flow into the internal space 61.

Next, a process of arranging the anode holder 60 illustrated in FIGS. 5 to 12 to be housed in the plating bath 50 illustrated in FIG. 4 will be explained. To have the anode holder 60 housed in the plating bath 50, at first, the gripped parts 64-1 and 64-2 are gripped by the chuck 47*a* or 47*b* of the transporter 42 or 44 illustrated in FIG. 2. As a result, as illustrated in FIG. 10, the push rod 95 is pressed down, so that the shaft 93 moves in the direction opposite to the biasing direction of the spring 96. Further, the valve 91 moves away from the valve seat 99 so that the hole 71 is opened, as illustrated in FIG. 12.

By lowering the arm 45 (see FIG. 2), the transporter 42 or 44 arranges the anode holder 60 of which the hole 71 is in the open state to be housed in the plating bath 50. The arm parts 70-1 and 70-2 of the anode holder 60 are supported from underneath thereof by the supporting members 51-1 and 51-2 (see FIG. 2) of the plating bath 50. The anode holder 60 is soaked in the plating solution Q, and the plating solution Q flows into the internal space 61 through the hole 71 that is opened. At the same time, the air in the internal space 61 is discharged through the air discharging port 81, so that the internal space 61 is filled with the plating solution Q.

When the internal space 61 is filled with the plating solution Q, the transporter 42 or 44 releases the gripped parts 64-1 and 64-2 from the gripping of the chuck 47*a* or 47*b* (see FIG. 2) and raises the arm 45 (see FIG. 2). The anode holder 60 is thus hung and held in the plating bath 50. At this time, as the arm 45 rises, the shaft 93 is returned to the original position thereof by the biasing force of the spring 96. As a result, the valve 91 tightly adheres to the valve seat 99 via the third sealing member 92, so that the hole 71 is sealed shut.

When the hole 71 is sealed shut, the plating solution Q that is present in the internal space 61 of the anode holder 60 is separated from the plating solution Q held in the plating bath 50, while the diaphragm 66 is interposed therebetween. As a result, it is possible to prevent any black film forming in the internal space 61 from spreading to the outside of the internal space 61. Further, even if oxygen or monovalent copper is generated in the vicinity of the anode 40, it is possible to prevent decomposition of the additives from progressing, because the plating solution Q held in the plating bath 50 does not go into the internal space 61.

To replace the anode 40 or the diaphragm 66 during maintenance work or the like, at first, the chuck 47*a* or 47*b* (FIG. 2) of the transporter 42 or 44 grips the gripped parts 64-1 and 64-2 of the anode holder 60 arranged in the plating bath 50. At this time, the valve 91 moves away from the valve seat 99 so that the hole 71 is opened, as illustrated in FIG. 12. The transporter 42 or 44 takes the gripped anode holder 60 out of the plating solution Q and holds the anode holder 60 still above the plating bath 50. In that situation, the plating solution Q in the internal space 61 is discharged into the plating bath 50 through the hole 71 that is opened. The anode holder 60 of which the internal space 61 has become empty is washed and dried by being routed through the second rinsing bath 32*b* and the blow bath 34 and is subsequently transported to the holder relay unit 72 (see FIG. 3). After that, the anode holder 60 is taken out of the holder relay unit 72 by an operator, so that the anode 40 or the diaphragm 66 is replaced.

Also, when the anode holder 60 is soaked in a rinsing fluid (pure water) held in the second rinsing bath 32*b*, as a result of the gripped parts 64-1 and 64-2 of the anode holder 60 being gripped by the chuck 47*a* or 47*b* of the transporter 42 or 44, the rinsing fluid flows into the internal space 61 through the hole 71 that is opened. As a result, the internal space 61 of the anode holder 60 is washed and cleaned, and the maintenance work therefore can easily be performed.

As explained above, because the anode holder 60 includes the valve 91 that seals the hole 71 shut, it is possible to seal the hole 71 shut, after soaking the anode holder 60 in the plating solution Q and filling the internal space 61 with the plating solution Q. With this arrangement, it is possible to inhibit any black film forming in the internal space 61 from spreading to the outside of the internal space 61. Further, even if oxygen or monovalent copper is generated in the vicinity of the anode 40, it is possible to inhibit the decomposition of the additives from progressing, because the plating solution Q held in the plating bath 50 does not go into the internal space 61.

The anode holder 60 includes: the spring 96 (an biasing member) that biases the valve 91 so that the valve 91 seals the hole 71 shut; and the push rod 95 (the operation part) that operates the valve 91 so that the valve 91 becomes open and opens the hole 71. With this arrangement, the valve 91 is able to seal the hole 71 shut at normal times, while it is possible to easily open the hole 71 with the use of the push rod 95.

Further, the push rod 95 is provided in the gripped part 64-2. With this arrangement, the transporter 42 or 44 is able to operate the push rod 95 by gripping the gripped part 64-2. Accordingly, because there is no need to provide a mechanism for operating the push rod 95 besides the transporter 42 or 44, it is not necessary to provide the plating apparatus with any special mechanism for operating the push rod 95.

The anode holder 60 includes the shaft 93, the intermediate member 94, and the pivot 94*a*. One end of the shaft 93 is connected to the valve 91, whereas the other end thereof is connected to the spring 96. One end of the intermediate member 94 is connected to the shaft 93, whereas the other end thereof is connected to the push rod 95. The pivot 94*a* rotatably fixes the intermediate member 94. One end of the push rod 95 protrudes from the gripped part 64-2, whereas the other end thereof is connected to the other end of the intermediate member 94. Further, when the push rod 95 is pressed down into the inside of the gripped part 64-2, the valve 91 moves in the direction opposite to the direction of the biasing force of the spring 96. With this arrangement, the transporter 42 or 44 is able to operate the push rod 95 by gripping the gripped part 64-2. Further, it is possible to operate the valve 91 to open by operating the push rod 95.

The anode holder 60 includes the first sealing member 84 that hermetically seals the gap between diaphragm 66 and the internal space 61. With this arrangement, it is possible to prevent any black film forming in the internal space 61 from spreading through the gap between the diaphragm 66 and the internal space 61. Further, it is possible to prevent the plating solution Q held in the plating bath 50 from entering the internal space 61 through the gap between the diaphragm 66 and the internal space 61, and it is therefore possible to inhibit decomposition of the additives from progressing.

The anode holder 60 has the opening 69 which communicates with the rear face of the internal space 61. It is therefore possible to easily replace the anode 40 via the opening 69. Further, the anode holder includes the lid 86 covering the opening 69 and the second sealing member 85 that hermetically seals the gap between the opening 69 and the lid 86. With this arrangement, it is possible to prevent any black film forming in the internal space 61 from spreading through the gap between the opening 69 and the lid 86. Further, it is possible to prevent the plating solution Q held in the plating bath 50 from entering the internal space 61 through the gap between the opening 69 and the lid 86, and it is therefore possible to inhibit decomposition of the additives from progressing.

The anode holder 60 includes the air discharging port 81. With this arrangement, it is possible to discharge the air in the internal space 61 and to supply the plating solution Q to the internal space 61 through the hole 71.

The diaphragm 66 is an ion exchange membrane or a neutral membrane. With this arrangement, it is possible to pass cations from the anode side to the cathode side during the plating process, without passing the additives or black films in the plating solution.

Further, the plating apparatus 100 according to the first embodiment includes the transporter 42 and 44, while the valve 91 included in the anode holder 60 is configured so as to open when the transporter 42 or 44 grips the anode holder 60 and so as to close when the transporter 42 or 44 releases the grip. With this arrangement, when the anode holder 60 is soaked in the plating solution Q while being gripped, it is possible to fill the internal space 61 with the plating solution Q. Further, when the anode holder 60 is released from the grip so as to be housed in the plating bath 50, the valve 91 is able to seal the hole 71 shut. Further, when the anode holder 60 is taken out of the plating solution Q while being gripped for the purpose of replacing the anode 40 or the like, because the valve 91 becomes open, it is possible to discharge the plating solution Q in the internal space 61 through the hole 71.

Further, in the first embodiment, as the configuration to open and close the valve 91, the shaft 93, the spring 96, the intermediate member 94, the pivot 94*a*, the push rod 95, and the like are provided. However, possible embodiments are not limited to this example. It is acceptable to adopt any other configuration capable of opening and closing the valve 91. Although the anode holder 60 is configured so that the holder base 62 is provided with the opening 69 for the convenience during a replacement of the anode 40, it is not necessary to provide the opening 69 when the anode 40 is replaced by using other methods.

Second Embodiment

Next, a plating apparatus according to a second embodiment will be explained. The plating apparatus according to the second embodiment is different from the plating apparatus according to the first embodiment for configurations of the plating bath 50 and the anode holder 60. Because the other configurations are the same as those in the first embodiment, explanations of the configurations other than those of the plating bath 50 and the anode holder 60 will be omitted.

Figure 13:
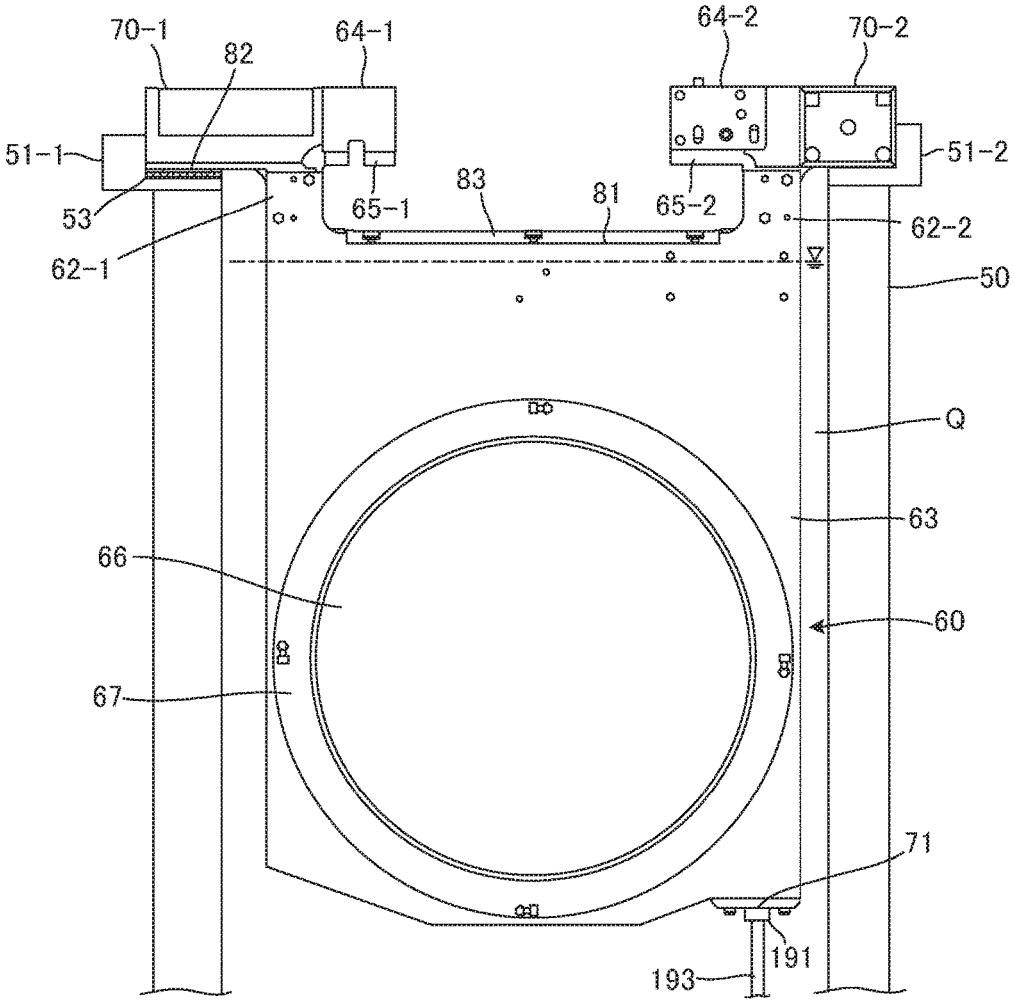
FIG. 13 is a schematic lateral cross-sectional view of a plating bath included in a plating apparatus according to second embodiment.

FIG. 13 is a schematic lateral cross-sectional view of the plating bath 50 included in the plating apparatus according to the second embodiment. As illustrated in FIG. 13, the plating bath 50 is configured so as to house the anode holder 60 therein by causing the supporting members 51-1 and 51-2 provided in the upper sections of the lateral walls to support lower sections of the gripped parts 64-1 and 64-2 of the anode holder 60. The supporting member 51-1 includes a conductive plate 53 that is positioned so as to be in contact with the electrode terminal 82 of the anode holder 60 and is connected to the positive electrode of the power source 90 illustrated in FIG. 4. Accordingly, when the anode holder 60 is housed in the plating bath 50, an electric current flows between the power source 90 and the anode holder 60, as a result of the electrode terminal 82 comes into contact with the conductive plate 53.

Further, the plating bath 50 includes a shaft 193 that vertically extends from the bottom thereof (not illustrated) and a valve 191 connected to an end of the shaft 193. While the anode holder 60 is housed in the plating bath 50 as illustrated in FIG. 13, the valve 191 is able to seal the hole 71 of the anode holder 60 shut.

Figure 14:
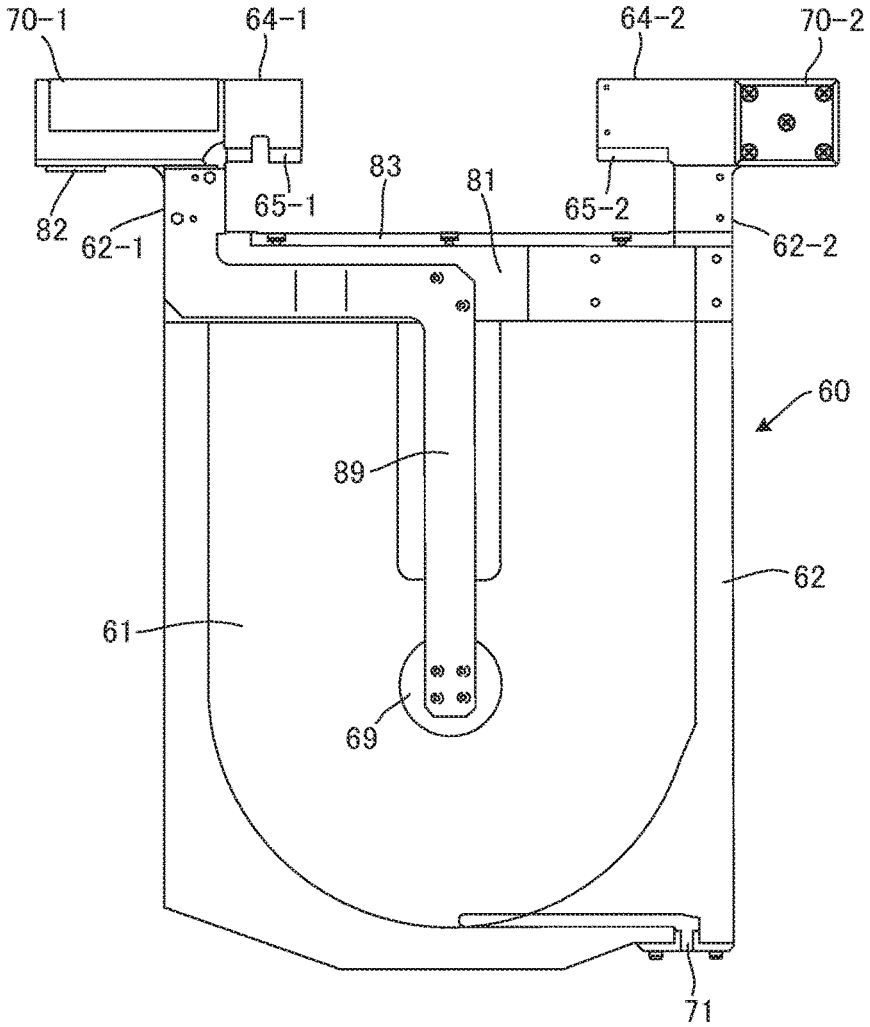
FIG. 14 is a plan view of an anode holder from which a holder base cover is removed.

FIG. 14 is a plan view of the anode holder 60 illustrated in FIG. 13 from which the holder base cover 63 is removed. For the sake of convenience. FIG. 14 illustrates the anode holder 60 from which the anode 40 is removed, while the gripped parts 64-1 and 64-2 are illustrated as being transparent. As illustrated in FIG. 14, the anode holder 60 does not include the push rod 95, the spring 96, the shaft 93, and the valve 91 described in the first embodiment. In contrast, similarly to the first embodiment, the anode holder 60 has the hole 71 that extends from the outer surface of the lower section thereof to the internal space 61 so as to communicate with the internal space 61.

Figure 15:
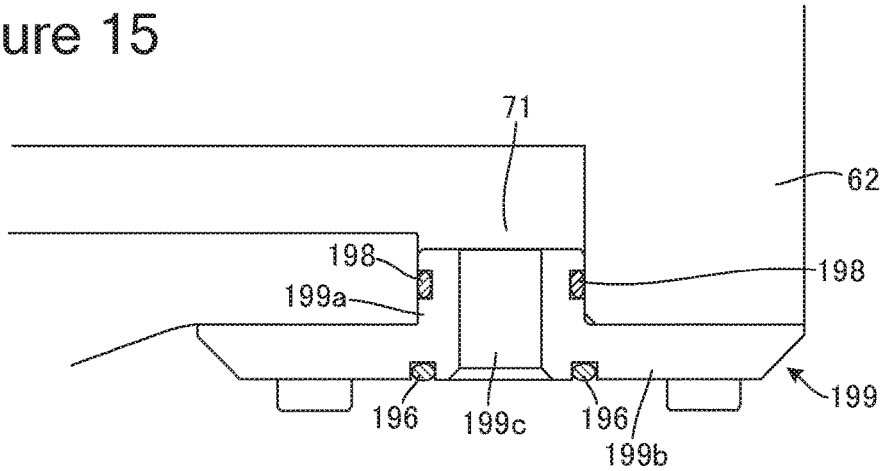
FIG. 15 is an enlarged view of a hole.
Figure 16:
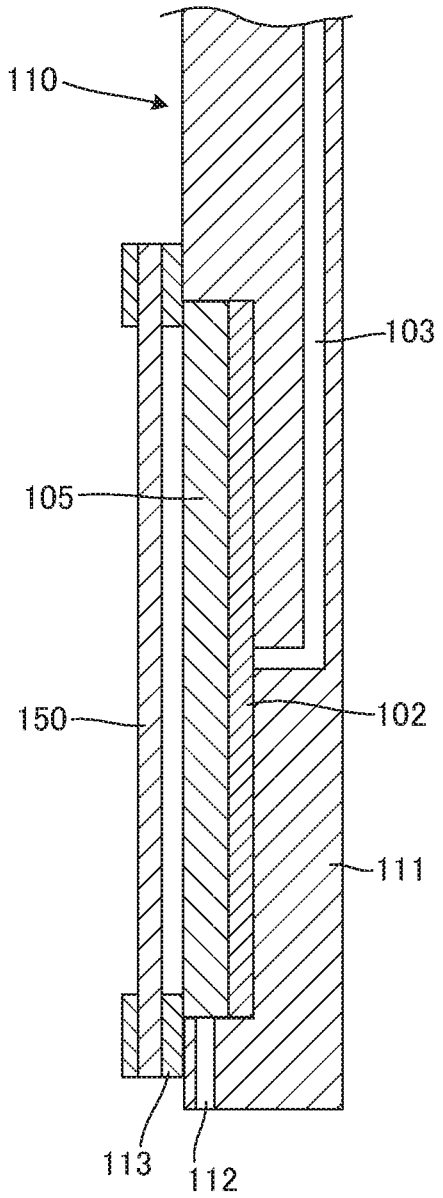
Figure 16 Prior Art
FIG. 16 is a partial cross-sectional view of a conventional anode holder including a diaphragm.

FIG. 15 is an enlarged view of the hole 71 illustrated in FIG. 14. The holder base 62 includes a valve seat 199 that receives the valve 191 illustrated in FIG. 13. The valve seat 199 includes an insertion part 199*a* inserted in the hole 71, a fixation part 199*b* fixed to a lower section of the holder base 62, and a hole 199*c* which communicates with the hole 71. The hole 71 is configured so as to communicate between the internal space 61 (see FIG. 14) and the outside of the holder base 62 via the hole 199*c*.

The insertion part 199*a* is formed to have a substantially circular cylindrical shape. Unlike in the first embodiment, the insertion part 199*a* does not include the third sealing member 92 (see FIG. 11). An annular-shaped fifth sealing member 198 configured with an O-ring, for example, is provided in an outer circumferential section of the insertion part 199*a*. The fifth sealing member 198 is configured to hermetically seal the gap between the hole 71 and the valve seat 199, so as to prevent the plating solution from passing through the gap between the hole 71 and the valve seat 199.

For example, an annular-shaped sixth sealing member 196 configured with an O-ring, for example, is provided along the outer circumference of the hole 199*c*, in a lower section of the fixation part 199*b*. When the anode holder 60 is housed in the plating bath 50 (see FIG. 13), the sixth sealing member 196 is in contact with the valve 191. As a result, the hole 71 is sealed shut.

Next, a process of arranging the anode holder 60 illustrated in FIGS. 13 to 15 to be housed in the plating bath 50 illustrated in FIG. 13 will be explained. To have the anode holder 60 housed in the plating bath 50, at first, the gripped parts 64-1 and 64-2 are gripped by the chuck 47*a* or 47*b* of the transporter 42 or 44 illustrated in FIG. 2. By lowering the arm 45 (see FIG. 2), the transporter 42 or 44 arranges the anode holder 60 of which the hole 71 is in the open state to be housed in the plating bath 50. The arm parts 70-1 and 70-2 of the anode holder 60 are supported from underneath thereof by the supporting members 51-1 and 51-2 (see FIG. 2) of the plating bath 50. The anode holder 60 is soaked in the plating solution Q, and the plating solution Q flows into the internal space 61 through the hole 71 that is opened. At the same time, the air in the internal space 61 is discharged through the air discharging port 81, so that the internal space 61 is filled with the plating solution Q.

When the internal space 61 is filled with the plating solution Q, the transporter 42 or 44 arranges the anode holder 60 to be in the final position in the plating bath 50, i.e., the position illustrated in FIG. 13. When the anode holder 60 is arranged in the final position in the plating bath 50, the valve 191 tightly adheres to the valve seat 199 via the sixth sealing member 196, so that the hole 71 is sealed shut.

When the hole 71 is sealed shut, the plating solution Q that is present in the internal space 61 of the anode holder 60 is separated from the plating solution Q held in the plating bath 50 while the diaphragm 66 is interposed therebetween. As a result, it is possible to prevent any black film forming in the internal space 61 from spreading to the outside of the internal space 61. Further, even if oxygen or monovalent copper is generated in the vicinity of the anode 40, it is possible to prevent decomposition of the additives from progressing, because the plating solution Q held in the plating bath 50 does not go into the internal space 61.

To replace the anode 40 or the diaphragm 66 during maintenance work or the like, at first, the chuck 47*a* or 47*b* (FIG. 2) of the transporter 42 or 44 grips the gripped parts 64-1 and 64-2 of the anode holder 60 arranged in the plating bath 50. The transporter 42 or 44 takes the gripped anode holder 60 out of the plating solution Q and holds the anode holder 60 still above the plating bath 50. As a result of the anode holder 60 being raised, the valve 191 moves away from the valve seat 199, so that the hole 71 is opened. The plating solution Q in the internal space 61 is discharged into the plating bath 50 through the hole 71 that is opened. The anode holder 60 of which the internal space 61 has become empty is washed and dried by being routed through the second rinsing bath 32*b* and the blow bath 34 and is subsequently transported to the holder relay unit 72 (see FIG. 3). After that, the anode holder 60 is taken out of the holder relay unit 72 by an operator, so that the anode 40 or the diaphragm 66 is replaced.

As explained above, because the plating bath 50 includes the valve 191 that seals the hole 71 of the anode holder 60 shut, it is possible to seal the hole 71 shut after soaking the anode holder 60 in the plating solution Q and filling the internal space 61 with the plating solution Q. With this arrangement, it is possible to inhibit any black film forming in the internal space 61 from spreading to the outside of the internal space 61. Further, even if oxygen or monovalent copper is generated in the vicinity of the anode 40, it is possible to inhibit the decomposition of the additives from progressing, because the plating solution Q held in the plating bath 50 does not go into the internal space 61.

Further, because the valve 191 is configured so as to seal the hole 71 shut, when the anode holder 60 is housed in the plating bath 50, there is no need to provide a special operating mechanism to open and close the valve 191.

In the second embodiment, although the anode holder 60 includes the valve seat 199 that is in contact with the valve 191, it is also acceptable to configure the anode holder 60 so as not to include the valve seat 193 in such a manner that the sixth sealing member 196 is provided directly underneath the holder base 62.

Although the exemplary embodiments of the present invention have been described above, the present invention is not limited to the embodiments described above. It is possible to apply various modifications thereto without departing from the scope of the technical concepts set forth in the claims, the specification, and the drawings.

REFERENCE SIGNS LIST

10: Cassette
12: Cassette Table
14: Aligner
16: Substrate Transporting Device
17: Spin Drier
18: Substrate Holder
20: Substrate Attaching And Detaching Unit
22: Rail
24: Mount Plate
26: Stocker
28: Pre-Wetting Bath
30: Pre-Soaking Bath
32*a*: First Rinsing Bath
32*b*: Second Rinsing Bath
34: Blow Bath
36: Paddle Driving Device
40: Anode
41: Substrate Holder Transporting Device
42: First Transporter
44: Second Transporter
45: Arm
46: Supporting Pillar
47*a*: Chuck
47*b*: Chuck
50: Plating Bath
51-1: Supporting Member
51-2: Supporting Member
52: Plating Processing Tank
53: Conductive Plate
54: Plating Solution Discharging Tank
55: Partition Wall
56: Plating Solution Supplying Port
57: Plating Solution Discharging Port
58: Plating Solution Circulating Device
60: Anode Holder
61: Internal Space
62: Holder Base
62-1: Connecting Part
62-2: Connecting Part
63: Holder Base Cover
63*a*: Opening
64-1: Gripped Part
64-2: Gripped Part
65-1: Tapered Part
65-2: Tapered Part
66: Diaphragm
67: Anode Mask
68: Diaphragm Presses
69: Opening
70-1: Arm Part
70-2: Arm Part
71: Hole
72: Holder Relay Unit
73: Door
74: Linear Guide
75: Hanging Bar
77: Holder Supporting Part
78: Opening Area
81: Air Discharging Port
82: Electrode Terminal
83: Lid
84: First Sealing Member
85: Second Sealing Member
86: Lid
88: Fixing Member
89: Power Supply Member
90: Power Source
91: Valve
92: Third Sealing Member
93: Shaft
93*a*: Pin
94: Intermediate Member
94*a*: Pivot
95: Push Rod
95*a*: Pin
96: Spring
97*a*: Spring Seat
97*b*: SPRING SEAT
98: Fourth Sealing Member
99: Valve Seat
99*a*: Insertion Part
99*b*: Fixation Part
99*c*: Hole
100: Plating Apparatus
191: Valve
193: Shaft
196: Sixth Sealing Member
198: Fifth Sealing Member
199: Valve Seat
199*a*: Insertion Part
199*b*: Fixation Part
199*c*: Hole
Q: Plating Solution
W: Substrate
W1: Surface

The invention claimed is:

1. An anode holder that holds an anode used in a plating apparatus, the anode holder is configured to be vertically received in a space housing plating solution of a plating bath of the plating apparatus during a plating process, the anode holder comprising:

an internal space of the anode holder that is formed on an inside of the anode holder and that houses the anode therein;

a diaphragm configured so as to cover a front face of the internal space of the anode holder;

a hole that is formed on an external surface of the anode holder and which communicates the space housing the plating solution of the plating bath with the internal space of the anode holder;

a valve that seals the hole shut;

a biasing member that biases the valve to close;

an operation part that operates the valve so as to open;

a gripped part to be gripped when the anode holder is transported;

a shaft of which one end is connected to the valve and of which another end is connected to the biasing member;

an intermediate member of which one end is connected to the shaft and of which another end is connected to the operation part;

a pivot that rotatably fixes the intermediate member;

wherein the operation part is provided in the gripped part;

wherein the operation part is a push rod of which one end protrudes from the gripped part and of which another end is connected to said another end of the intermediate member; and wherein when the push rod is pressed down into an inside of the gripped part, the valve moves in a direction opposite to a direction of a biasing force of the biasing member.

2. The anode holder according to claim 1, comprising:

a first sealing member configured so as to hermetically seal a gap between the diaphragm and the front face of the internal space.

3. The anode holder according to claim 1, comprising:

an opening which communicates with a rear face of the internal space;

a lid that covers the opening; and a second sealing member configured to hermetically seal a gap between the opening and the lid.

4. The anode holder according to claim 1, wherein the diaphragm is one of an ion exchange membrane and a neutral membrane.

5. A plating apparatus, comprising a plating bath housing the anode holder according to claim 1, and a transporter that transports the anode holder, wherein the valve is configured so as to open when the transporter grips the anode holder and so as to close when the transporter releases the grip.

* * * * *